United States Patent [19]

Eby

[11] Patent Number: 4,879,549

[45] Date of Patent: Nov. 7, 1989

[54] SHROUD ATTACHMENT

[76] Inventor: George W. Eby, 29188 S. Grayshill Rd., Colton, Oreg. 97017

[21] Appl. No.: 683,695

[22] Filed: Dec. 19, 1984

[51] Int. Cl.[4] ..... G08G 3/00

[52] U.S. Cl. ..... 340/815.2; 340/425.5; 40/541

[58] Field of Search ..... 340/815.2, 119, 114 R, 340/114 B, 27, 47, 48, 51, 81 R; 40/610, 903, 541-557; D20/17; 116/63 R

[56] References Cited

U.S. PATENT DOCUMENTS

| | | | |
|---|---|---|---|
| 1,640,831 | 8/1927 | Hunt | 340/815.2 |
| 2,407,382 | 9/1946 | Powers | 116/63 R |
| 3,448,538 | 6/1969 | Maze | 40/541 |
| 4,087,785 | 5/1978 | Dodich | 40/550 |
| 4,158,222 | 6/1979 | Cook | 340/22 |
| 4,571,868 | 2/1986 | Forestal | 40/590 |

OTHER PUBLICATIONS

Union Switch and Signal Co., Jan. 21, 1938, pp. 1-5, Illuminated Sign.

*Primary Examiner*—David K. Moore
*Assistant Examiner*—M. Fatahiyar
*Attorney, Agent, or Firm*—Kolisch, Hartwell & Dickinson

[57] ABSTRACT

A shroud attachment for use in combination with a warning device, the device including a panel having at least one orifice; a lamp having a portion thereof clearance received within the orifice and having another portion thereof abutted against the face of the panel about the periphery of the orifice. The shroud attachment of the instant invention includes a tubular shroud and a shroud carrier. One end of the shroud is positioned to abut a portion of a lamp which is mounted on a panel of a warning device such that the shroud retains the lamp on the panel. The shroud carrier, in turn, affixes the shroud to the panel. The carrier has a collar portion fitted about the periphery of one end of the shroud and a flange portion extending about the collar portion. The flange portion is substantially normal to the collar portion and attaches the shroud carrier to the panel.

10 Claims, 1 Drawing Sheet

SHROUD ATTACHMENT

BACKGROUND AND SUMMARY OF THE INVENTION

The invention of the instant application relates to lighted warning device and a shroud attachment therefor. Specifically, the shroud attachment of the instant invention is one which may be used to retain a lamp on a warning device panel.

Lighted warning panels, and more particularly, those panels which are used as highway warning devices, are generally portable devices which may be mounted on a light trailer or pickup truck bed. One of the most familiar types of warning devices includes a panel with a bi-directional arrow defined thereon by a set of lights. The arrow design of the panel includes a horizontally extending lighted array with an arrow head at each end thereof. Conventional circuitry is provided to enable the warning device to illuminate an arrow pointing in either of two directions. Additionally, circuitry may be provided which enables sequential lighting of the horizontal commencing at a light most distal from the arrow head and sequentially illuminating lights closer to the arrow head, finally illuminating the arrow head itself.

Other forms of warning devices may include a substantially rectangular panel with a light located in each of the four corners thereof and appropriate circuitry to flash the lights in a predetermined sequence in order to call attention to a warning sign displayed in the central portion of the panel.

The lamps used on the warning device as thus far described are generally high-intensity driving or aircraft landing lights. Because of the intensity of the beam produced by the lamp, it is necessary to provide a shroud about the bulb to insure that the warning device is visible from a distance, by a driver approaching the device head on, but to preclude side scattering of light beams which would tend to interfere with a driver's vision as the driver came abeam of the warning device.

Known warning device shrouds are generally formed of injection molded plastic and provide, as an integral portion of the shroud, a mounting flange, also formed of plastic. In the normal course of handling such warning devices, the shroud attachments are frequently damaged or broken due to rough handling of the warning devices, normal wear and tear, or as the result of weather and other environmental forces.

An object of the instant invention is to provide a shroud attachment which is both durable and which is economical to manufacture.

Another object of the instant invention is to provide a shroud attachment which will secure a light in place on a warning device.

Another object of the instant invention is to provide a shroud attachment which is easily replaced.

Yet another object of the instant invention is to provide a shroud attachment suitable to fix shrouds of various lengths to a warning device.

Another object of the instant invention is to provide a shroud attachment which allows for placement of a filter between the lamp and an observer, thereby to change the transmitted color of a warning light.

The shroud attachment of the instant invention includes a tubular shroud and a shroud carrier. One end of the shroud is positioned to abut a portion of a lamp which is mounted on a panel of a warning device such that the shroud retains the lamp on the panel. The shroud carrier, in turn, affixes the shroud to the panel. The carrier has a collar portion fitted about the periphery of one end of the shroud and a flange portion extending about the collar portion. The flange portion is substantially normal to the collar portion and attaches the shroud carrier to the panel.

These and other objects and advantages of the instant invention will become more fully apparent as the description which follows is read in conjunction with the drawings.

DETAILED DESCRIPTION OF THE PREFERRED EMBODIMENT

Figure 1:
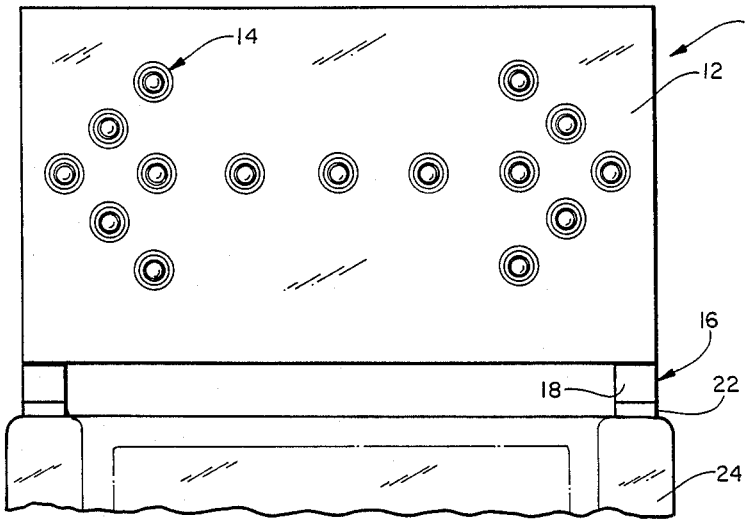
FIG. 1 is a front plan view of a warning device utilizing the shroud attachment of the instant invention.
Figure 2:
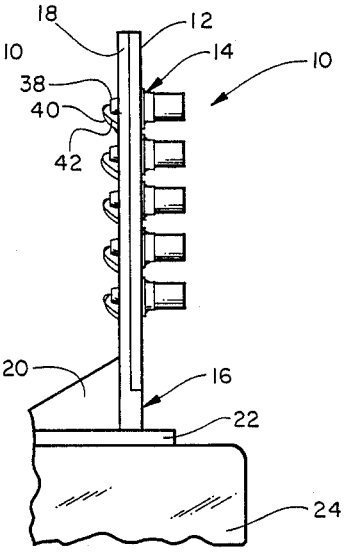
FIG. 2 is a side plan view of the warning device of FIG. 1.

Turning now to the drawings, and initially to FIGS. 1 and 2, a warning device incorporating a shroud attachment of the instant invention is shown generally at 10. Device 10 includes a panel 12 having a series of lamp assemblies, such as that shown at 14, mounted thereon.

Panel 12 is secured to a mounting stand 16 having an upright support 18, a brace 20, and a platform 22. Device 10 is shown mounted on the rear of a pickup truck 24.

Figure 3:
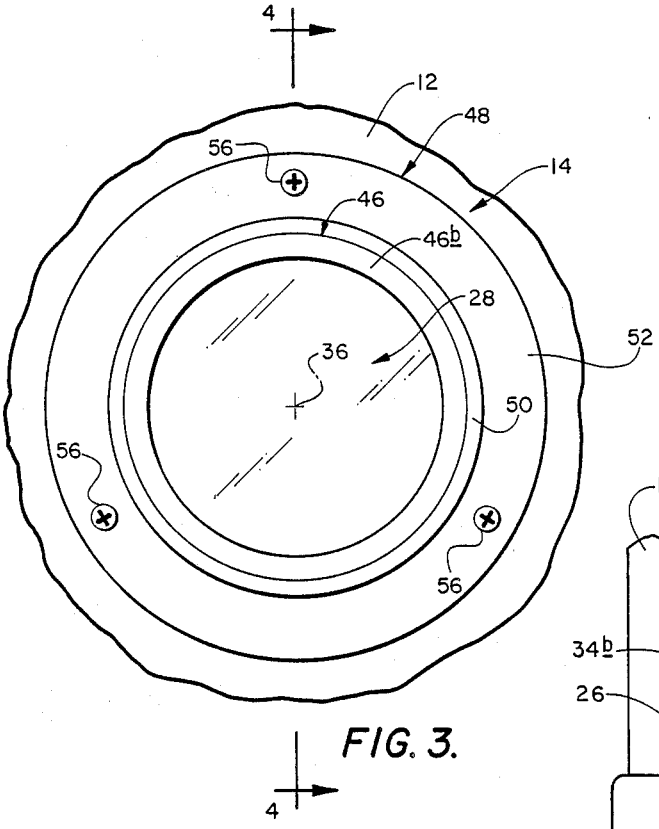
FIG. 3 is a front elevation of a shroud attachment constructed according to the instant invention.
Figure 4:
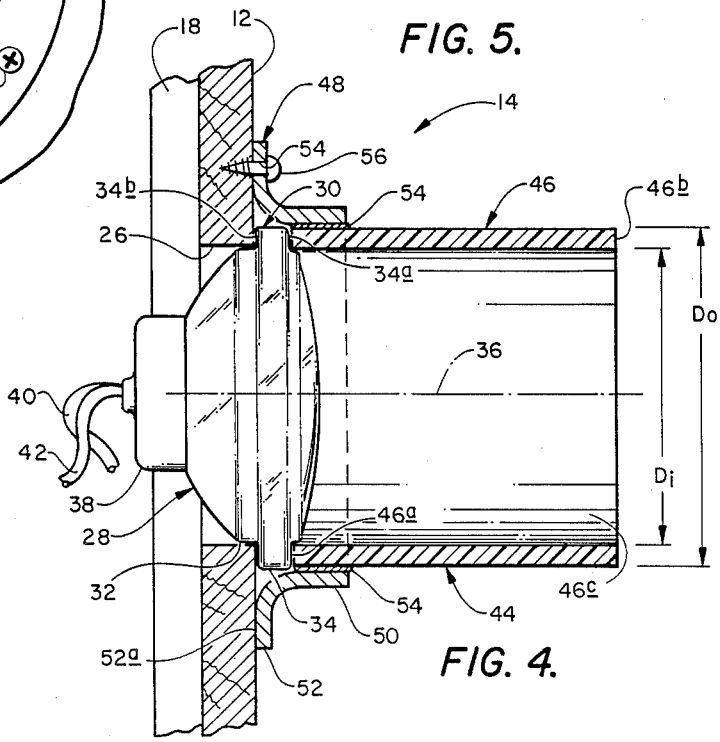
FIG. 4 is a medial section of the shroud attachment, taken generally along the line 4—4 in FIG. 3.

Turning now to FIGS. 3 and 4, lamp assembly 14 is shown in greater detail. Panel 12 has an orifice or lamp receiving bore 26 formed therein. Lamp 28 has an annular flange or lip, shown generally at 30, extending about its periphery and bounded by an outer annular surface 34 and front and rear sides or faces **34*a*, 34*b*. Rear side 34*b* of the lamp lip joins with a step surface 32 of lesser diameter than the outer diameter of flange 34, the step surface being snugly received within bore 26. Rear face 34*b* abuts panel 12 in a region extending about the periphery of bore 26. Lip 30 has an inner diameter, represented by dimension $D_i$ in FIG. 4**, and an outer diameter represented by dimension $D_o$.

Lamp 28 projects a beam having an axis of projection 36. Lip 30 extends substantially concentrically with and substantially normal to axis of projection 36.

To complete the description of lamp 28, conventional electrical connections are made at the rear of lamp 28 and are enclosed by a weather proof shield 38 which allows the passage of electrical wires 40, 42 therefrom. Wires 40, 42 are connected to conventional electrical controls and a power source (not shown). In the preferred embodiment, lamp 28 is a sealedbeam aircraft landing light, rated at 100 watts and requiring a 13 volt power supply. Such a lamp is manufactured by the General Electric Company and marketed under the model No. GE 4509. Many other types of lights are available and would be equally suitable for use in the warning device.

A lamp shroud attachment is shown generally at 44. Attachment 44 includes a cylindrical, tubular shroud 46, which, in the preferred embodiment, is formed of suitable plastic material, such as ABS or PVC. Shroud 46 has an inner diameter which is substantially conformal to dimension $D_i$ and an outer diameter which is substantially conformal to dimension $D_o$. In the preferred embodiment, $D_i$ is approximately four inches. Shroud 46 may be cut from readily available four-inch ID plastic pipe, which is both durable and relatively inexpensive. Such pipe generally has a sidewall thickness of approximately onequarter inch and $D_o$ has a value, therefor, of approximately four one-half inches.

A shroud carrier, or carrier means 48, includes a collar portion 50 and a generally planar flange portion 52. Collar portion 50 has an inner diameter enabling it to be snugly fitted about the outer diameter of shroud 46, and one end **46*a* of shroud 46 is received in collar portion 50. Shroud end 46*a* is fixed in collar portion 50 with the end of the shroud spaced apart from the rear surface 52*a* of flange 52 by a distance substantially equal to the distance between front face 34*a* and rear face 34*b* of lamp annular flange 34. Such spacing provides that shroud end 46*a* abuts front face 34*a* of lamp 28 thereby retaining the lamp on panel 12. Shroud 46 is adhesively secured to carrier 48 by adhesive 54 (shown with greatly exaggerated thickness) to retain the desired spacing between shroud end 46*a* and flange rear surface 52*a***.

Flange portion 52 includes plural bores 54 therein to facilitate attachment of shroud carrier 48 to panel 12. In the preferred embodiment, three bores are provided for receiving fasteners, such as screws 56, for removably, fixedly attaching flange portion 52 to panel 12. Screws 56 are also referred to herein as securing means.

In the preferred embodiment, flange portion 52 is substantially normal to axis of projection 36 and is constructed with collar portion 50 such that collar portion 50 and shroud 48 received therein are concentric with axis of projection 36. Collar portion 50 and flange portion 52 are integrally formed as a unitary element, referred to herein as shroud carrier means.

Shrouds of varying length can be provided for a warning device and such shrouds can be interchanged to best suit existing road and weather conditions. Although the shroud formed according to the instant invention is extremely durable, it is foreseeable that some damage may occur requiring replacement of a shroud. Although shroud 46 is adhesively secured to carrier 48, the shroud could be removed and a new shroud received in carrier 48 to replace a broken predecessor.

Figure 5:
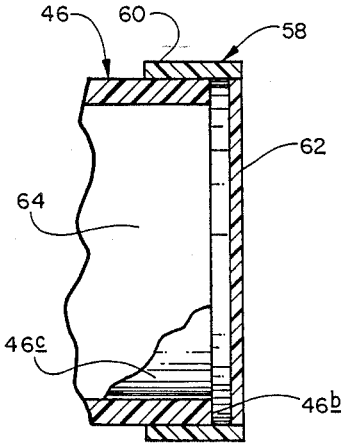
FIG. 5 is a median sectional view similar to FIG. 4, showing a filter mounted on a shroud.

Turning now to FIG. 5, modifications of shroud 46 are disclosed. A first modification is the provision of a translucent filter, shown generally at 58, which enables the warning device to project beams of various colored light without having to install lamps having colored lenses on the panel. Carrier 58 includes an outer filter carrying ring 60 which has an inside diameter substantially conformal to the outside diameter of shroud 46, facilitating easy placement and removal. A translucent, colored filter 62 is secured to ring 60 for altering the color of light by transmitted lamp 28.

Another modification of shroud 48 includes provision of an inner, reflectorized surface, such as that shown at 64, which enhances the intensity of the beam projected by lamp 28. Surface 64 can be applied to inner shroud surface **46*c* as by spray painting or the provision of a metallic, inner sleeve. Use of an inner reflectorized surface on shroud 46** provides a beam of light which is of the requisite intensity, but which is initially generated by a lamp of lower wattage than would otherwise be required.

Although a preferred embodiment and modifications thereto have been described, it should be appreciated that other variations and modifications may be made without departing from the spirit of the invention.

It is claimed and desired to secure by letters patent:

1. In combination with a warning device including a panel having a front face and at least one orifice of predetermined size extending through the panel; a lamp having a back portion received within the orifice, said lamp further having an annular portion bounded by opposite sides and one side of the annular portion lying against said face of the panel in a region of the panel face extending about the periphery of the orifice; a shroud attachment comprising:

a tubular shroud having one end abutting the other side of the annular portion of the lamp with said region of the face of the panel and one end of the shroud retaining the lamp on the panel; and shroud carrier means mounting said shroud on the panel, said carrier means including a collar portion fitted about the periphery of said one end of said shroud and a flange portion extending about said collar portion, substantially normal to the axis of the collar portion, attaching said carrier means to the panel.

2. The combination of claim 1, wherein said shroud is adhesively secured to said carrier means.

3. The combination of claim 1, which further includes detachable securing means detachably attaching said flange portion to said panel.

4. The combination of claim 3, wherein said flange portion includes plural bores therein and said securing means includes fasteners received in said bores.

5. In a highway warning device, a panel having a front face and a bore extending through the panel;

a lamp having a front and a back and intermediate the front and back of the lamp a raised annular lip extending about the perimeter of the lamp, said lip being bounded by an outer annular surface and front and rear sides, the lamp further having an annular step surface of lesser diameter than the annular outer surface of said lip disposed rearwardly in the lamp from said lip, said lamp being mounted on said panel with said step surface snugly received within said bore and the rear side of the lip against the front face of the panel;

a cylindrical shroud having opposite ends disposed with the shroud concentric with lamp and with one end of the shroud against the front side of the lip in the lamp;

shroud carrier means including a collar portion and a planar flange portion joined to an end of the collar portion extending radially outwardly of the collar portion, said one end of the shroud being snugly fitted within said collar portion of said carrier means and said flange portion of said carrier means lying against the front face of the panel; and secured means detachably securing said collar portion of said carrier means to said panel.

6. The warning device of claim 5, wherein said flange portion has plural holes therein and said securing means includes fasteners received in said holes.

7. The warning device of claim 5, which further includes means for affixing a translucent filter adjacent the other end of said shroud.

8. The warning device of claim 5, wherein said shroud carrier means is an integrally formed unitary element.

9. The warning device of claim 5, wherein said shroud has an inner, reflectorized surface.

10. In combination with a warning device including a panel having a front face and an orifice of predetermined size opening to said front face; a lamp having a cylindrical surface portion snugly received within the orifice, said lamp further having an annular lip portion bounded by front and rear sides and an outer annular surface of greater diameter than said cylindrical surface portion and being mounted with the rear of said lip portion abutted against said face of the panel in a region extending about the periphery of the orifice; a shroud attachment comprising:

a tubular shroud having one end abutting the outer side of the lip portion of the lamp; and shroud carrier means for retaining said shroud adjacent the panel, said carrier means including a collar portion fitted about the periphery of said one end of said shroud and a flange portion extending about said collar portion, and projecting radially outwardly of the collar portion, said flange portion extending in a plane which is substantially normal to the axis of the collar portion and having a side which lies against the front face of said panel.

* * * * *